US008642907B2

(12) United States Patent
Slepian et al.

(10) Patent No.: US 8,642,907 B2
(45) Date of Patent: Feb. 4, 2014

(54) ELECTRICAL SWITCHING APPARATUS AND OPENING ASSEMBLY THEREFOR

(75) Inventors: Robert Michael Slepian, Murrysville, PA (US); Nathan James Weister, Darlington, PA (US)

(73) Assignee: Eaton Corporation, Cleveland, OH (US)

( * ) Notice: Subject to any disclaimer, the term of this patent is extended or adjusted under 35 U.S.C. 154(b) by 206 days.

(21) Appl. No.: 13/366,558

(22) Filed: Feb. 6, 2012

(65) Prior Publication Data

US 2013/0199910 A1 Aug. 8, 2013

(51) Int. Cl.
*H01H 5/00* (2006.01)

(52) U.S. Cl.
USPC ..... 200/468; 200/400

(58) Field of Classification Search
USPC ..... 200/468
See application file for complete search history.

(56) References Cited

U.S. PATENT DOCUMENTS 5,224,590 A * 7/1993 Milianowicz et al. ..... 200/400
6,788,172 B1 * 9/2004 Godesa et al. ..... 335/17
7,294,804 B1 * 11/2007 Gottschalk et al. ..... 200/400
7,449,653 B2 * 11/2008 Gibson et al. ..... 200/400
7,683,276 B2 3/2010 Weister et al.
8,063,328 B2 * 11/2011 Gottschalk et al. ..... 200/400

FOREIGN PATENT DOCUMENTS

EP 2 001 030 A1 12/2008
EP 2 001 032 A1 12/2008

OTHER PUBLICATIONS

European Patent Office, "International Search Report and Written Opinion", May 6, 2013.

* cited by examiner

*Primary Examiner* — Kyung Lee
(74) *Attorney, Agent, or Firm* — Eckert Seamans Cherin & Mellott, LLC; Grant E. Coffield

(57) ABSTRACT

An opening assembly is provided for an electrical switching apparatus having a housing, separable contacts enclosed by the housing, and an operating mechanism for opening and closing the separable contacts. The operating mechanism includes a poleshaft. The opening assembly includes a spring link comprising a first portion structured to be pivotably coupled to the poleshaft, and a second portion disposed generally opposite of the first portion. A number of opening springs each include a fixed end fixedly coupled to the housing, and a movable end coupled to the second portion of the spring link. The spring link is movable between an open position, wherein the opening springs bias the spring link and poleshaft to maintain full separation of the separable contacts, and a closed position, wherein the opening springs do not bias the poleshaft.

20 Claims, 5 Drawing Sheets

ELECTRICAL SWITCHING APPARATUS AND OPENING ASSEMBLY THEREFOR

BACKGROUND

1. Field

The disclosed concept relates generally to electrical switching apparatus and, more particularly, to electrical switching apparatus, such as circuit breakers. The disclosed concept also relates to opening assemblies for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are separable from the stationary electrical contacts.

FIGS. 1A and 1B, for example, show a portion of a power air circuit breaker 1. The power air circuit breaker 1 uses opening springs 3 (one opening spring 3 is shown in simplified form in FIGS. 1 and 2) to achieve and maintain full opening gap (e.g., separation of the electrical contacts) during opening and, in some cases, to augment the opening speed to improve interruption. In order to minimize the required closing energy, the minimum possible opening spring force and energy is desired. Each opening spring 3 is attached at its moving end to an arm 5, which is fixed to the poleshaft 7. This arrangement stretches the spring 3 from open length, Lo (FIG. 1A) to closed length, Lc (FIG. 1B) as the poleshaft 7 rotates from open (FIG. 1A) to closed (FIG. 1B). The poleshaft 7 is commonly designed to maintain a substantially constant moment arm (see, for example, open moment arm, Mo of FIG. 1A and closed moment arm, Mc of FIG. 1B).

Achieving and maintaining full opening gap becomes especially difficult after interruption, when debris and shunt behavior cause the opening force requirement to increase. One option is to strengthen the opening springs. However, strengthening the opening springs without a corresponding increase in closing springs may lead to stalling and incomplete closures. The difficulty of closing against stronger opening springs is more pronounced late in closing, once the moving contacts seat on the stationary contacts and the contact springs become a contributing factor. Increasing the closing springs to overcome stronger opening springs also adds cost, reduces life, and increases the requirements of some accessories such as, for example and without limitation, the closing solenoid and the charging motor. The foregoing difficulties become progressively more problematic as additional circuit breaker poles are added.

There is, therefore, room for improvement in electrical switching apparatus, such as circuit breakers, and in opening assemblies therefor.

SUMMARY

These needs and others are met by embodiments of the disclosed concept, which are directed to an opening assembly for electrical switching apparatus such as, for example and without limitation, circuit breakers. Among other benefits, the opening assembly arranges the opening springs in a manner which produces relatively large poleshaft torque at full open, to maintain open gap (e.g., separation of the electrical contacts), and substantially zero torque near the closed state, to ease the closing.

As one aspect of the disclosed concept, an opening assembly is provided for an electrical switching apparatus. The electrical switching apparatus includes a housing, separable contacts enclosed by the housing, and an operating mechanism for opening and closing the separable contacts. The operating mechanism includes a poleshaft. The opening assembly comprises: a spring link comprising a first portion structured to be pivotably coupled to the poleshaft, and a second portion disposed generally opposite of the first portion, the spring link being movable between an open position and a closed position; and a number of opening springs each including a fixed end structured to be fixedly coupled to the housing, and a movable end coupled to the second portion of the spring link. When the spring link is disposed in the open position, the number of opening springs are structured to bias the spring link and the poleshaft to maintain full separation of the separable contacts. When the spring link is disposed in the closed position, the number of opening springs are structured not to bias the poleshaft.

The spring link may further comprise an intermediate portion extending between the first portion and the second portion. The intermediate portion may have an arcuate shape in order that, when the spring link is disposed in the closed position, the spring link is structured to extend around a portion of the poleshaft.

The poleshaft may include an arm extending outwardly therefrom. The first portion of the spring link may be structured to be pivotably coupled to the arm. The spring link may be formed from a pair of substantially identical planar members disposed opposite and spaced apart from one another, wherein a portion of the arm of the poleshaft is structured to be disposed between the pair of substantially identical planar members.

As another aspect of the disclosed concept, an electrical switching apparatus comprises: a housing; separable contacts enclosed by the housing; an operating mechanism for opening and closing the separable contacts, the operating mechanism including a pole shaft; and an opening assembly comprising: a spring link comprising a first portion pivotably coupled to the poleshaft, and a second portion disposed generally opposite of the first portion, the spring link being movable between an open position and a closed position, and a number of opening springs each including a fixed end fixedly coupled to the housing, and a movable end coupled to the second portion of the spring link. When the spring link is disposed in the open position, the number of opening springs bias the spring link and the poleshaft to maintain full separation of the separable contacts. When the spring link is disposed in the closed position, the number of opening springs do not to bias the poleshaft.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1B:
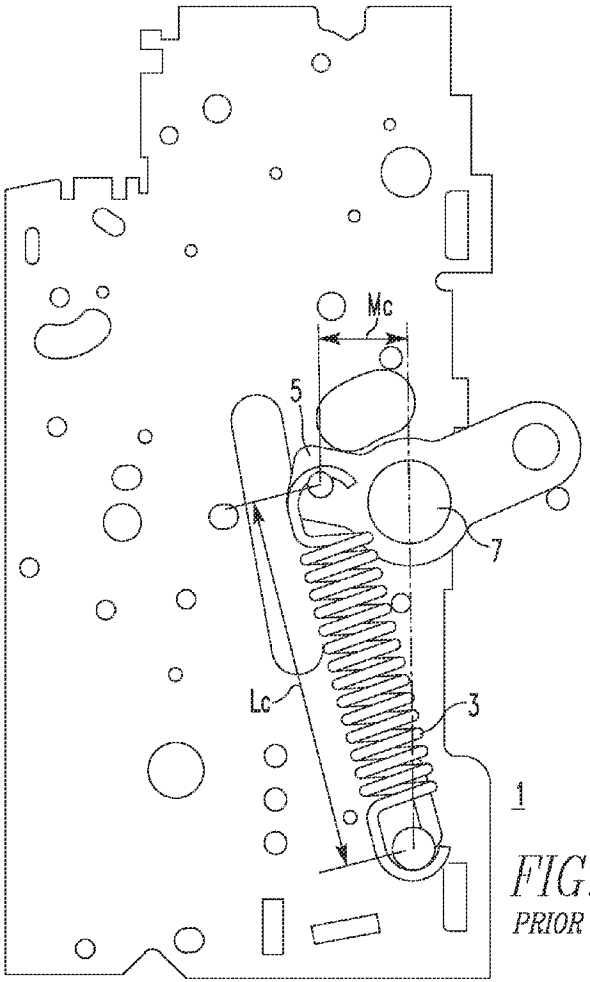
FIG. 1B PRIOR ART
FIGS. 1A and 1B are side elevation views of portions of a known circuit breaker and opening assembly therefor, with FIG. 1A corresponding to the circuit breaker being open and FIG. 1B corresponding to the circuit breaker being closed.
Figure 1A:
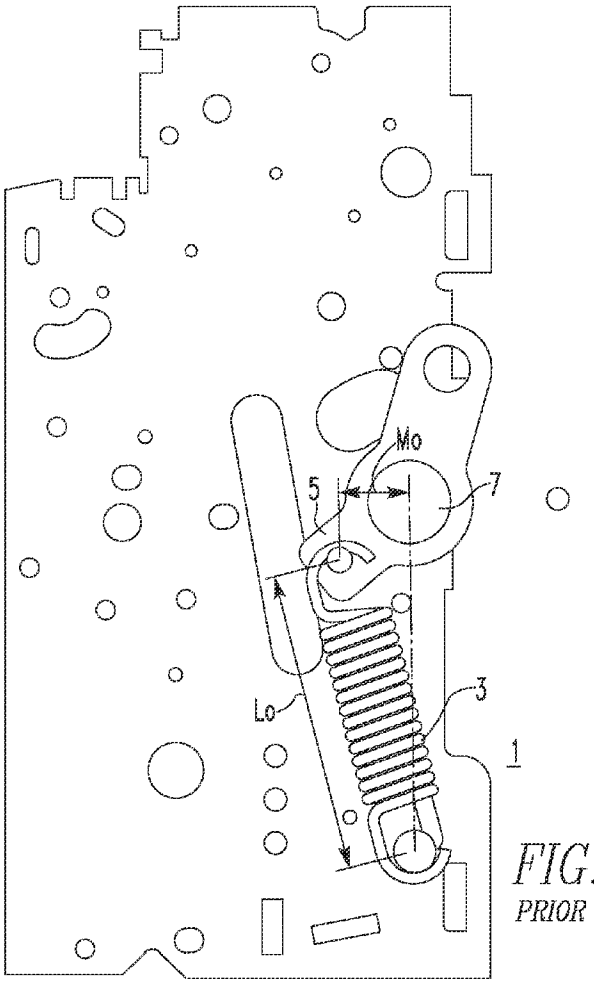
FIG. 1A PRIOR ART

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
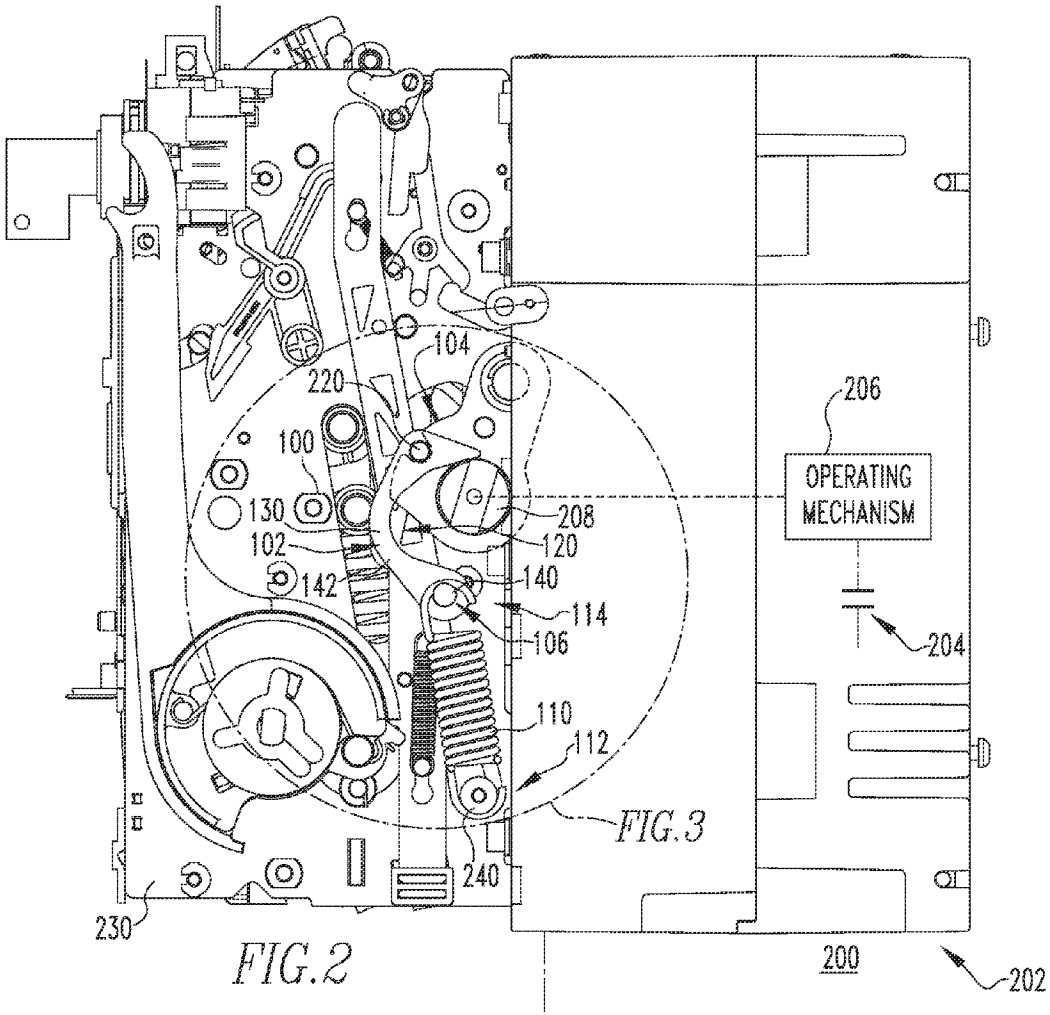
FIG. 2 is a side elevation view of a circuit breaker and opening assembly therefor, in accordance with an embodiment of the disclosed concept.

FIG. 2 shows an opening assembly 100 for an electrical switching apparatus such as, for example and without limitation, a circuit breaker 200. The circuit breaker 200 includes a housing 202, separable contacts 204 (shown in simplified form in FIG. 2) enclosed by the housing 202, and an operating mechanism 206 (shown in simplified form in FIG. 2) for opening and closing the separable contacts 204. The operating mechanism 206 includes a poleshaft 208 (best shown in the isometric view of FIG. 5).

Figure 4:
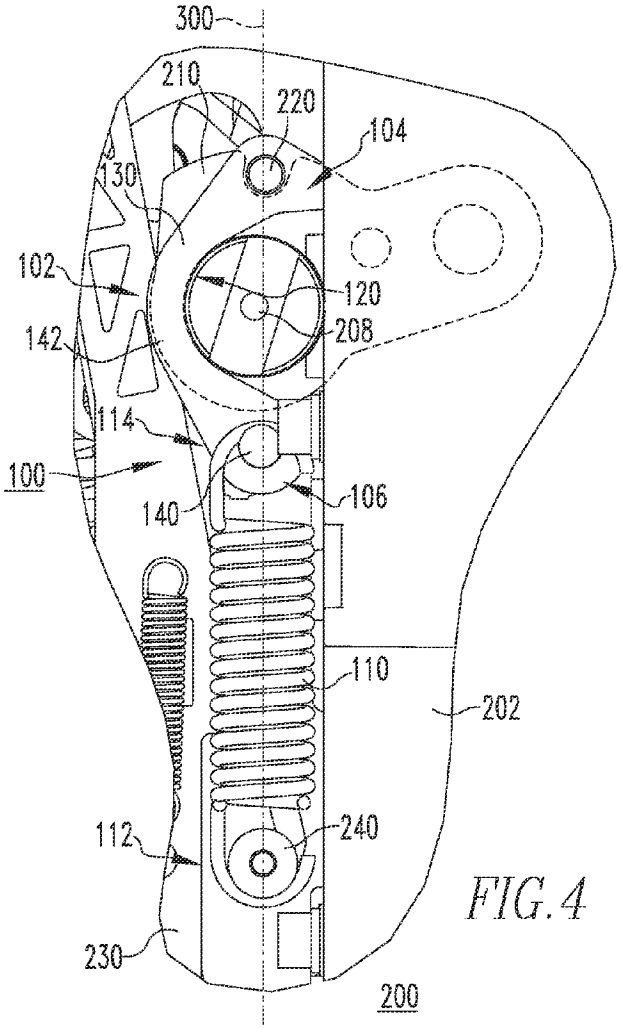
FIG. 4 is the enlarged view of FIG. 3, modified to show the opening assembly when the circuit breaker is closed.
Figure 3:
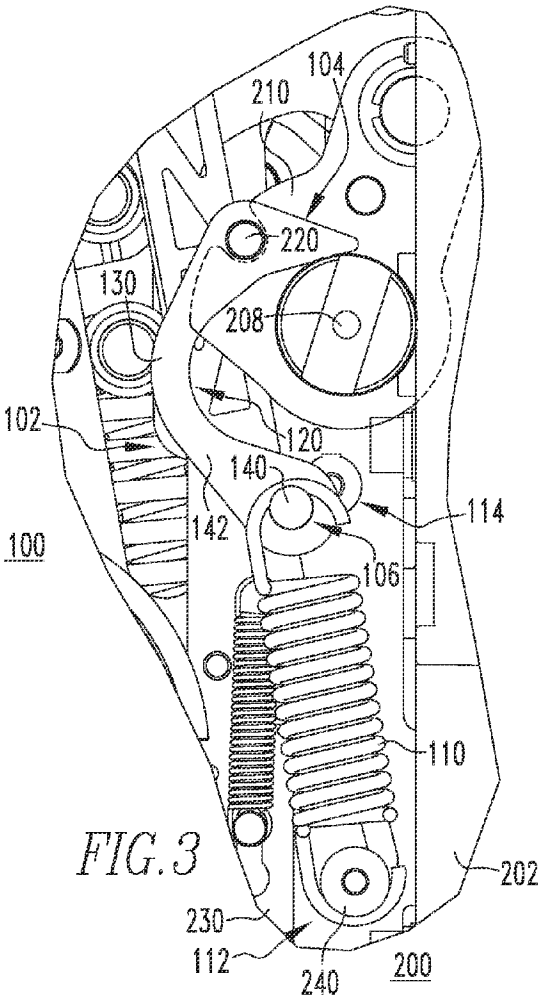
FIG. 3 is an enlarged view of the opening assembly of FIG. 2, shown as positioned when the circuit breaker is open.

The opening mechanism 100 includes a spring link 102 having a first portion 104 structured to be pivotably coupled to the poleshaft 208, and a second portion 106 disposed generally opposite the first portion 104. The spring link 102 is movable between an open position (FIGS. 2, 3, 5 and 6A) and a closed position (FIGS. 4 and 6B). The opening assembly 100 further includes a number of opening springs 110 each including a fixed end 112 fixedly coupled to the circuit breaker housing 202, and a movable end 114 coupled to the second portion 106 of the aforementioned spring link 102.

In view of the foregoing structure, when the spring link 102 is disposed in the open position, shown in FIGS. 2, 3, 5 and 6A, the opening spring(s) 110 is/are structured to bias the spring link 102 and the poleshaft 208 (e.g., counterclockwise from the perspective of FIG. 2) to maintain full separation of the separable contacts 204 (FIG. 2). In other words, the disclosed concept arranges the opening springs 110 and their attachment to the poleshaft 208, via the spring link 102, in a manner to produce relatively large poleshaft torque at full open (e.g., without limitation, to maintain open gap between the separable contacts 204 (FIG. 2)). Additionally, when the spring link 102 is disposed in the closed position of FIGS. 4 and 6B, the opening spring(s) 110 is/are structured not to bias the poleshaft 208. In other words, substantially zero torque is applied by the opening spring(s) 110 in the closed state, thereby reducing the required closing energy and associated stress on circuit breaker components. Furthermore, the reduced requirements for closing springs allows for a reduction in closing energy or increased closing margins. Reduced closing energy advantageously reduces the requirements on accessories (e.g., without limitation, spring release; motor operator) and increases lifespan. Increased closing margins accommodate changes and circuit breaker performance after interruption, without the need for increased closing speeds and/or reduced contact springs. The specific manner in which the disclosed opening assembly 100 achieves these benefits will be described in greater detail hereinbelow.

Continuing to refer to FIG. 2, and also to FIGS. 3-6B, the spring link 102 of the disclosed opening assembly 100 further includes an intermediate portion 120, which extends between the first and second portions 104,106 and preferably has an arcuate shape. Such arcuate shape enables the spring link 102 to extend around a portion of the circuit breaker poleshaft 208 when the spring link 102 is disposed in a closed position, shown in FIGS. 4 and 6B. As best shown in the isometric view of FIG. 5, the poleshaft 208 preferably includes an arm 210, which extends outwardly from the poleshaft 208. The first portion 104 of the spring link 102 is structured to be pivotably coupled to the arm 210. In the example shown and described herein, the spring link 102 is formed from a pair of substantially identical planar members 130,132, which are disposed opposite and spaced apart from one another. Accordingly, a portion of the arm 210 of the poleshaft 208 is disposed between the pair of substantially identical planar members 130,132, as shown. The poleshaft 208 further includes a pivot pin 220, which pivotably couples the spring link 102 to the poleshaft arm 210.

Figure 5:
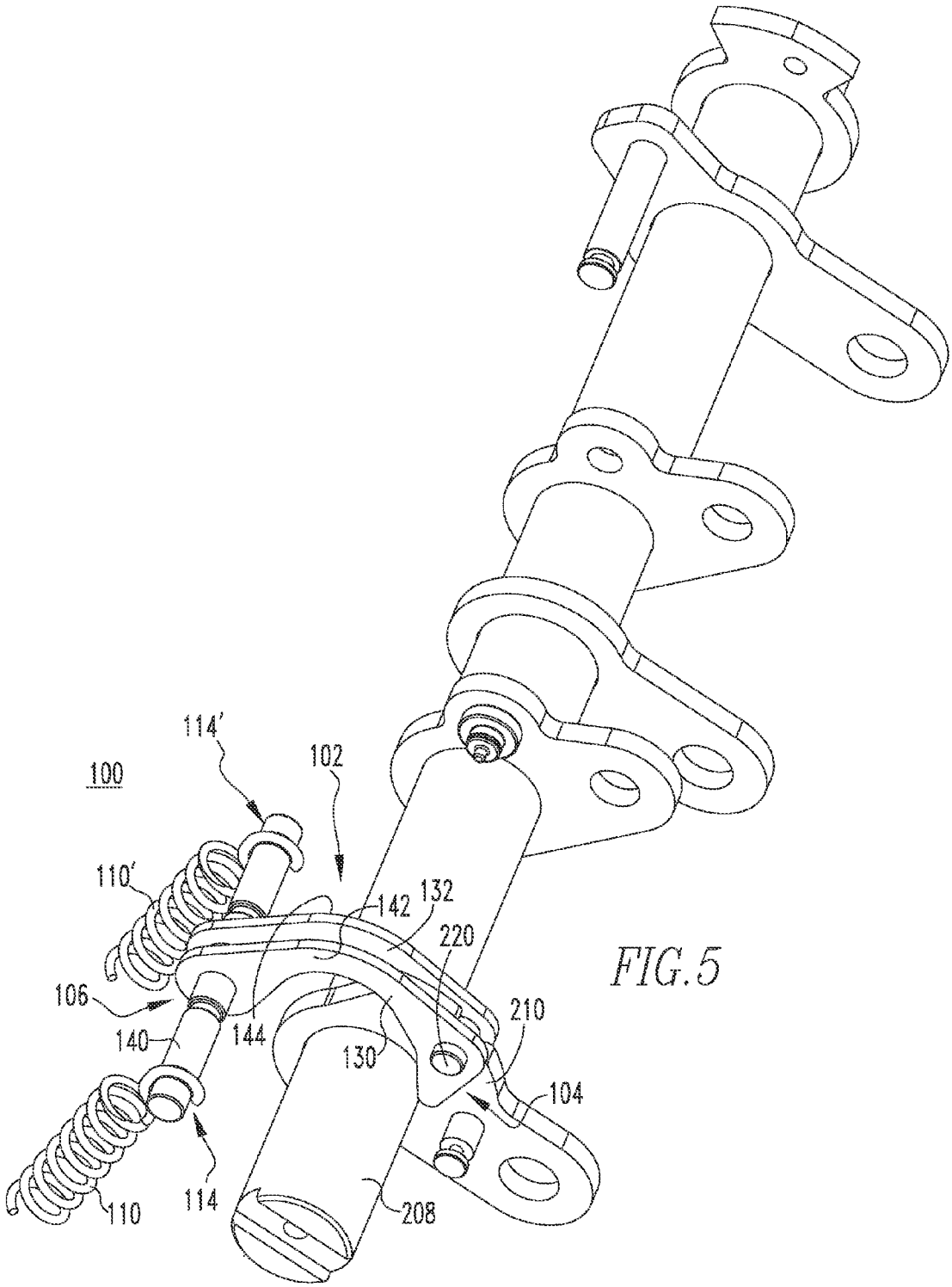
FIG. 5 is an isometric view of a portion of the opening assembly of FIG. 4.
Figure 6B:
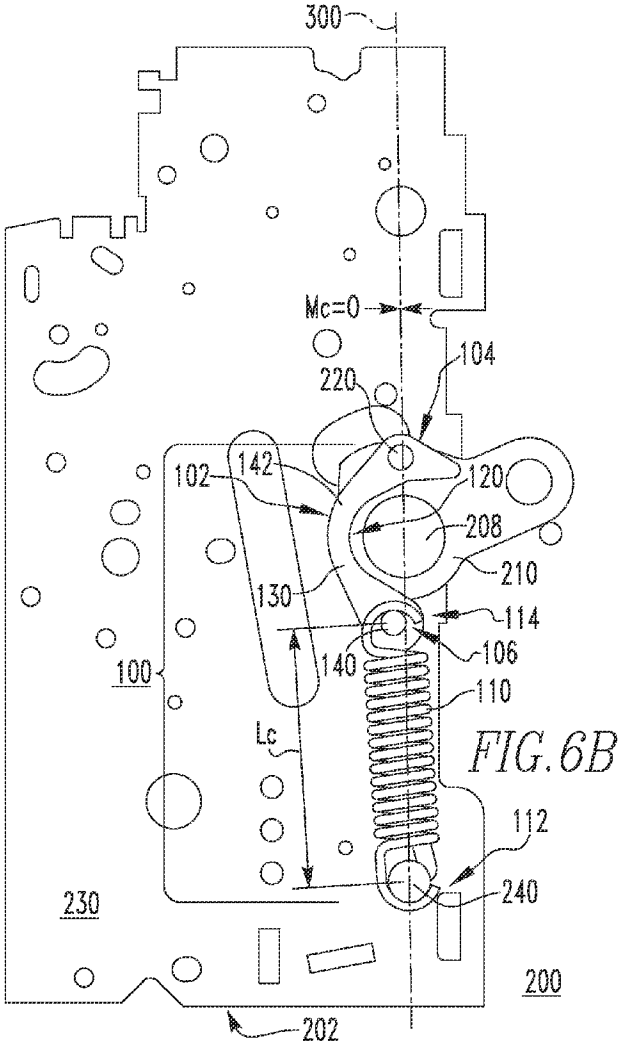
FIGS. 6A and 6B are side elevation views of portions of the circuit breaker and opening assembly therefor, in accordance with an embodiment of the disclosed concept, with FIG. 6A corresponding to the circuit breaker being open and FIG. 6B corresponding to the circuit breaker being closed.

Continuing to refer to FIG. 5, the spring link 102 of the opening assembly 100 further includes a projection 140 extending laterally outwardly from the second portion 106 of the spring link 102. In the example of FIG. 5, the projection is a pin 140, which extends laterally outwardly from the first side 142 of the spring link 102, in a first direction, and laterally outwardly from the second side 144 of the spring link 102, in a second direction opposite the first direction. As partially shown in the example of FIG. 5, more than one opening spring may be employed, without departing from the scope of the disclosed concept. For example, a first opening spring 110 includes a movable end 114 coupled to the pin 140 on the first side 142 of the spring link 102, and a second opening spring 110' includes a movable end 114', which is coupled to the pin 140 on the second side 144 of the spring link 102. It will, however, be appreciated that any known or suitable alternative number, type and/or configuration of spring links (e.g., 102) and/or opening springs (e.g., without limitation 110,110') could be employed. For economy of disclosure and ease of illustration, only one opening assembly 100 and spring link 102 therefor, is described in detail herein.

Figure 6A:
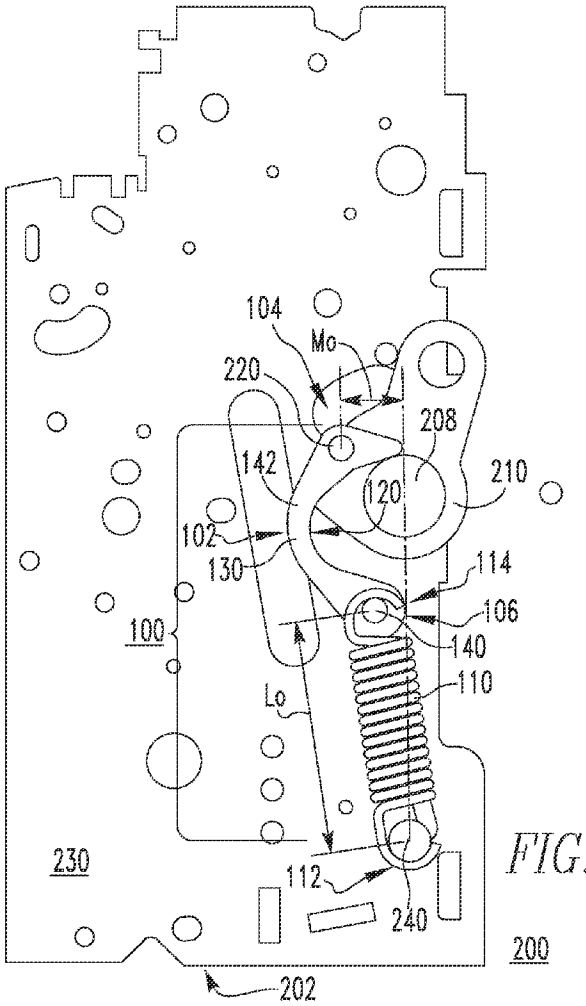

As shown in FIGS. 6A and 6B, the housing 202 of the example circuit breaker 200 includes a side plate 230 and at least one protrusion 240, which extends outwardly from the side plate 230, as shown. The fixed end 110 of each of the number of opening springs (e.g., 110) is fixedly coupled to a corresponding one of the at least one protrusions 240.

As shown in FIGS. 4 and 6B, in operation, when the spring link 102 is disposed in a closed position, the first portion 104 and the second portion 106 are generally disposed on opposite sides of the poleshaft 208, as shown. It will be appreciated that this results in the pivot pin 220, the poleshaft 208, and the opening spring(s) 110 being substantially aligned, as shown with reference, for example and without limitation, to the longitudinal axis 300. As shown, opening spring(s) 110, pin 140, poleshaft 208, pivot pin 220, and protrusion 240 are generally all aligned with axis 300. Accordingly, it will be appreciated that such alignment correspondingly results in substantially zero moment arm (see, for example, moment arm Mc=0 in FIG. 6B). In other words, substantially zero torque is applied by the opening spring(s) 110 to the spring link 102 or poleshaft 208, in the closed position, thereby reducing requirements for the closing springs and allowing a reduction in closing energy, as well as increased closing margins, as previously discussed hereinabove.

It will also be appreciated that the spring link 102 design of the disclosed opening assembly 100 achieves a moment arm, Mo, as desired, when the spring link 102 is disposed in the open position of FIG. 6A. As shown by comparing FIG. 6A to FIG. 6B, it will be appreciated that the opening spring length Lo, when the spring link 102 is in the open position of FIG. 6A, is relatively similar to the closed spring length Lc, when the spring link 102 is disposed in the closed position of FIG. 6B. This, in combination with the aforementioned closing moment arm, Mc being substantially zero (see FIG. 6B), have profound beneficial effects on the circuit breaker's operation. For example, the disclosed opening assembly 100 consumes less than 40 percent of the energy of conventional closing spring designs. Furthermore, the opening assembly 100 is capable of producing about 20 percent more poleshaft torque at full open and still consuming less of about half of the energy of conventional designs.

Accordingly, among other benefits, the disclosed opening assembly 100 provides a unique spring link 102 and opening spring 110 arrangement, which effectively functions to produce desired poleshaft torque at full open (e.g., without limitation, to maintain open gap between separable contacts 204 (FIG. 2)) and substantially zero torque in the closed state, thereby reducing the required closing energy and associated stress.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An opening assembly for an electrical switching apparatus, said electrical switching apparatus including a housing, separable contacts enclosed by the housing, and an operating mechanism for opening and closing said separable contacts, said operating mechanism including a poleshaft, said opening assembly comprising:

a spring link comprising a first portion structured to be pivotably coupled to said poleshaft, and a second portion disposed generally opposite of the first portion, said spring link being movable between an open position and a closed position; and a number of opening springs each including a fixed end structured to be fixedly coupled to the housing, and a movable end coupled to the second portion of said spring link, wherein, when said spring link is disposed in said open position, said number of opening springs are structured to bias said spring link and said poleshaft to maintain full separation of said separable contacts, and wherein, when said spring link is disposed in said closed position, said number of opening springs are structured not to bias said poleshaft.

2. The opening assembly of claim 1 wherein said spring link further comprises an intermediate portion extending between the first portion and the second portion; and wherein said intermediate portion has an arcuate shape in order that, when said spring link is disposed in said closed position, said spring link is structured to extend around a portion of said poleshaft.

3. The opening assembly of claim 1 wherein said poleshaft includes an arm extending outwardly therefrom; and wherein the first portion of said spring link is structured to be pivotably coupled to said arm.

4. The opening assembly of claim 3 wherein said spring link is formed from a pair of substantially identical planar members disposed opposite and spaced apart from one another; and wherein a portion of said arm of said poleshaft is structured to be disposed between said pair of substantially identical planar members.

5. The opening assembly of claim 3 wherein said poleshaft further includes a pivot pin; and wherein the first portion of said spring link is structured to be pivotably coupled to said arm of said poleshaft by said pivot pin.

6. The opening assembly of claim 5 wherein said spring link further comprises a projection extending laterally outwardly from the second portion of said spring link; and wherein the movable end of each of said number of springs is coupled to said projection.

7. The opening assembly of claim 6 wherein said spring link further comprises a first side and a second side; wherein said projection is a pin; and wherein said pin extends laterally outwardly from the first side of said spring link in a first direction and laterally outwardly from the second side of said spring link in a second direction opposite the first direction.

8. The opening assembly of claim 7 wherein said number of opening springs is a first opening spring and a second opening spring; wherein the movable end of said first opening spring is coupled to said pin on the first side of said spring link; and wherein the movable end of said second opening spring is coupled to said pin on the second side of said spring link.

9. The opening assembly of claim 7 wherein the housing of said electrical switching apparatus includes a side plate and at least one protrusion extending outwardly from said side plate; and wherein the fixed end of each of said number of opening springs is structured to be fixedly coupled to a corresponding one of said at least one protrusion.

10. The opening assembly of claim 9 wherein, when said spring link is disposed in said closed position, the first portion and the second portion are structured to be disposed on opposite sides of said poleshaft and said pivot pin, said poleshaft, and said number of opening springs are substantially aligned.

11. An electrical switching apparatus comprising:

a housing;

separable contacts enclosed by the housing;

an operating mechanism for opening and closing said separable contacts, said operating mechanism including a pole shaft; and an opening assembly comprising:

a spring link comprising a first portion pivotably coupled to said poleshaft, and a second portion disposed generally opposite of the first portion, said spring link being movable between an open position and a closed position, and a number of opening springs each including a fixed end fixedly coupled to the housing, and a movable end coupled to the second portion of said spring link, wherein, when said spring link is disposed in said open position, said number of opening springs bias said spring link and said poleshaft to maintain full separation of said separable contacts, and wherein, when said spring link is disposed in said closed position, said number of opening springs do not to bias said poleshaft.

12. The electrical switching apparatus of claim 11 wherein said spring link further comprises an intermediate portion extending between the first portion and the second portion; and wherein said intermediate portion has an arcuate shape in order that, when said spring link is disposed in said closed position, said spring link extends around a portion of said poleshaft.

13. The electrical switching apparatus of claim 11 wherein said poleshaft includes an arm extending outwardly therefrom; and wherein the first portion of said spring link is pivotably coupled to said arm.

14. The electrical switching apparatus of claim 13 wherein said spring link is formed from a pair of substantially identical planar members disposed opposite and spaced apart from one another; and wherein a portion of said arm of said poleshaft is disposed between said pair of substantially identical planar members.

15. The electrical switching apparatus of claim 13 wherein said poleshaft further includes a pivot pin; and wherein the first portion of said spring link is pivotably coupled to said arm of said poleshaft by said pivot pin.

16. The electrical switching apparatus of claim 15 wherein said spring link further comprises a projection extending laterally outwardly from the second portion of said spring link; and wherein the movable end of each of said number of springs is coupled to said projection.

17. The electrical switching apparatus of claim 16 wherein said spring link further comprises a first side and a second side; wherein said projection is a pin; and wherein said pin extends laterally outwardly from the first side of said spring link in a first direction and laterally outwardly from the second side of said spring link in a second direction opposite the first direction.

18. The electrical switching apparatus of claim 17 wherein said number of opening springs is a first opening spring and a second opening spring; wherein the movable end of said first opening spring is coupled to said pin on the first side of said spring link; and wherein the movable end of said second opening spring is coupled to said pin on the second side of said spring link.

19. The electrical switching apparatus of claim 17 wherein the housing includes a side plate and at least one protrusion extending outwardly from said side plate; and wherein the fixed end of each of said number of opening springs is fixedly coupled to a corresponding one of said at least one protrusion.

20. The electrical switching apparatus of claim 19 wherein, when said spring link is disposed in said closed position, the first portion and the second portion are disposed on opposite sides of said poleshaft and said pivot pin, said poleshaft, and said number of opening springs are substantially aligned.

* * * * *